US009708998B2

(12) United States Patent
Shibata et al.

(10) Patent No.: US 9,708,998 B2
(45) Date of Patent: Jul. 18, 2017

(54) SYSTEM AND METHOD FOR IMPROVING FUEL DELIVERY ACCURACY BY DETECTING AND COMPENSATING FOR FUEL INJECTOR CHARACTERISTICS

(71) Applicant: GM Global Technology Operations LLC, Detroit, MI (US)

(72) Inventors: Jonathan T. Shibata, Whitmore Lake, MI (US); Michael J. Lucido, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 419 days.

(21) Appl. No.: 14/242,058

(22) Filed: Apr. 1, 2014

(65) Prior Publication Data

US 2015/0275808 A1 Oct. 1, 2015

(51) Int. Cl.

*F02D 41/30* (2006.01)
*F02D 41/20* (2006.01)
*F02D 41/24* (2006.01)

(52) U.S. Cl.

CPC ..... *F02D 41/3005* (2013.01); *F02D 41/20* (2013.01); *F02D 41/2467* (2013.01); *F02D 2041/2051* (2013.01); *F02D 2041/2055* (2013.01); *F02D 2200/0602* (2013.01)

(58) Field of Classification Search

CPC .. F02D 41/3005; F02D 41/20; F02D 41/2467; F02D 2041/2051; F02D 2041/2055; F02D 2200/0602

USPC .... 701/101–104; 73/114.43, 114.45, 114.49, 73/114.51; 123/472, 478, 488, 494

See application file for complete search history.

(56) References Cited

U.S. PATENT DOCUMENTS 7,525,234 B2 * 4/2009 Martin ..... F02D 41/2096 310/316.03
7,715,950 B2 * 5/2010 Lasseter ..... H02P 9/04 318/798
9,074,552 B2 * 7/2015 Shibata ..... F02D 41/401
(Continued)

FOREIGN PATENT DOCUMENTS

EP 2685074 A1 1/2014
GB 201320692 11/2013

OTHER PUBLICATIONS

U.S. Appl. No. 14/231,807, filed Apr. 1, 2014, Lucido et al.
(Continued)

*Primary Examiner* — Thomas Moulis
*Assistant Examiner* — Susan Scharpf

(57) ABSTRACT

A fuel control system according to the principles of the present disclosure includes a voltage measuring module, a first difference module, a second difference module, a third difference module, and an injector driver module. The voltage measuring module measures first and second voltages at first and second electrical connectors of a fuel injector of an engine. The first difference module determines a first difference based on a difference between the first and second voltages. The second difference module determines a second difference between (i) the first difference and (ii) a previous value of the first difference. The third difference module determines a third difference between (i) the second difference and (ii) a previous value of the second difference. The injector driver module selectively applies power to the fuel injector based on the third difference.

21 Claims, 6 Drawing Sheets

(56) References Cited

U.S. PATENT DOCUMENTS

| | | | | |
|---|---|---|---|---|
| 2005/0178360 | A1 | 8/2005 | Satou | |
| 2007/0227506 | A1 | 10/2007 | Perryman et al. | |
| 2008/0129305 | A1 | 6/2008 | Perryman et al. | |
| 2011/0023836 | A1* | 2/2011 | Verner | F02D 41/20 123/490 |
| 2013/0024098 | A1 | 1/2013 | Li et al. | |
| 2013/0054120 | A1 | 2/2013 | Yamada | |
| 2014/0000564 | A1 | 1/2014 | Shibata et al. | |
| 2015/0275807 | A1* | 10/2015 | Lucido | F02D 41/3005 701/103 |
| 2015/0275809 | A1* | 10/2015 | Shibata | F02D 41/3005 701/104 |
| 2015/0275815 | A1* | 10/2015 | Shibata | F02D 41/3809 123/490 |

OTHER PUBLICATIONS

U.S. Appl. No. 14/242,001, filed Apr. 1, 2014, Shibata et al.
U.S. Appl. No. 14/242,247, filed Apr. 1, 2014, Shibata et al.
Glossary of Judicial Claim Constructions in the Electronics, Computer and Business Method Arts. Public Patent Foundation. (2010).

* cited by examiner

SYSTEM AND METHOD FOR IMPROVING FUEL DELIVERY ACCURACY BY DETECTING AND COMPENSATING FOR FUEL INJECTOR CHARACTERISTICS

CROSS-REFERENCE TO RELATED APPLICATIONS

This application is related to U.S. patent application Ser. No. 14/242,001 filed on Apr. 1, 2014, Ser. No. 14/242,247 filed on Apr. 1, 2014 and Ser. No. 14/231,807 filed on Apr. 1, 2014. The entire disclosure of the above applications are incorporated herein by reference.

FIELD

The present application relates to internal combustion engines, and more particularly, to systems and methods for improving fuel delivery accuracy by detecting and compensating for fuel injector characteristics.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs. The driver inputs may include, for example, accelerator pedal position, brake pedal position, and/or one or more other suitable driver inputs.

SUMMARY

A fuel control system according to the principles of the present disclosure includes a voltage measuring module, a first difference module, a second difference module, a third difference module, and an injector driver module. The voltage measuring module measures first and second voltages at first and second electrical connectors of a fuel injector of an engine. The first difference module determines a first difference based on a difference between the first and second voltages. The second difference module determines a second difference between (i) the first difference and (ii) a previous value of the first difference. The third difference module determines a third difference between (i) the second difference and (ii) a previous value of the second difference. The injector driver module selectively applies power to the fuel injector based on the third difference A first fuel control method according to the principles of the present disclosure includes measuring first and second voltages at first and second electrical connectors of a fuel injector of an engine and determining a first difference based on a difference between the first and second voltages. The method further includes determining a second difference between (i) the first difference and (ii) a previous value of the first difference, determining a third difference between (i) the second difference and (ii) a previous value of the second difference, and selectively applying power to the fuel injector based on the third difference.

A second fuel control method according to the principles of the present disclosure includes measuring first and second voltages at first and second electrical connectors of a fuel injector of an engine and determining a first derivative based on a difference between the first and second voltages. The method further includes determining a second derivative based on (i) the first derivative and (ii) a previous value of the first derivative, determining a third derivative based on (i) the second derivative and (ii) a previous value of the second derivative, and selectively applying power to the fuel injector based on the third derivative.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel within cylinders to generate drive torque. A throttle valve regulates airflow into the engine. Fuel is injected by fuel injectors. Spark plugs may generate spark within the cylinders to initiate combustion. Intake and exhaust valves of a cylinder may be controlled to regulate flow into and out of the cylinder.

The fuel injectors receive fuel from a fuel rail. A high pressure fuel pump receives fuel from a low pressure fuel pump and pressurizes the fuel within the fuel rail. The low pressure fuel pump draws fuel from a fuel tank and provides fuel to the high pressure fuel pump. The fuel injectors inject fuel directly into the cylinders of the engine.

Different fuel injectors, however, may have different opening and closing characteristics. For example, fuel injectors from different fuel injector manufacturers may have different opening and closing characteristics. Even fuel injectors from the same fuel injector manufacturer, however, may have different opening and closing characteristics. Example opening and closing characteristics include, for example, opening period and closing period. The opening period of a fuel injector may refer to the period between a first time when power is applied to the fuel injector to open the fuel injector and a second time when the fuel injector actually opens in response to the application of power. The closing period of a fuel injector may refer to the period between a first time when power is removed from the fuel injector to close the fuel injector and a second time when the fuel injector reaches a fully closed state in response to the removal of power.

The present application involves determining various parameters based on a difference between voltages at first and second electrical conductors of a fuel injector. More specifically, parameters that track second, third, and fourth (order) derivatives of the difference are determined using a plurality of sums and differences. An engine control module (ECM) determines characteristics of the fuel injector based on these parameters. The ECM controls application of power to the fuel injector based on the characteristics of the fuel injector.

Figure 1:
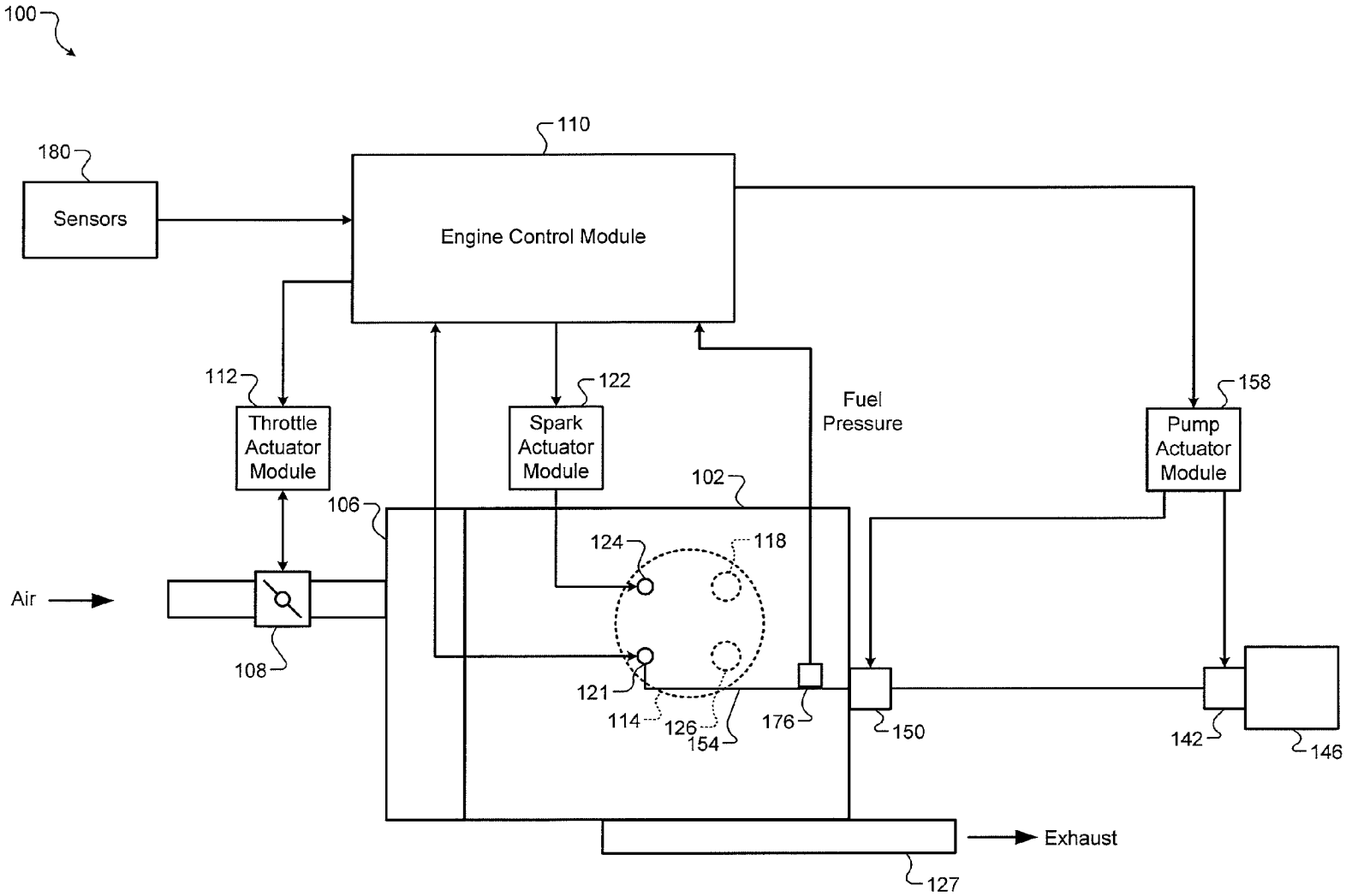
FIG. 1 is a functional block diagram of an example direct injection engine system.

Referring now to FIG. 1, a functional block diagram of an example engine system 100 for a vehicle is presented. The engine system 100 includes an engine 102 that combusts an air/fuel mixture to produce drive torque for the vehicle. While the engine 102 will be discussed as a spark ignition direct injection (SIDI) engine, the engine 102 may include another type of engine. One or more electric motors and/or motor generator units (MGUs) may be provided with the engine 102.

Air is drawn into an intake manifold 106 through a throttle valve 108. The throttle valve 108 may vary airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through an intake valve 118. One or more intake valves may be provided with each cylinder.

The ECM 110 controls fuel injection into the cylinder 114 via a fuel injector 121. The fuel injector 121 injects fuel, such as gasoline, directly into the cylinder 114. The fuel injector 121 is a solenoid type, direct injection fuel injector. Solenoid type, direct injection fuel injectors are different than port fuel injection (PFI) injectors and piezo electric fuel injectors. The ECM 110 may control fuel injection to achieve a desired air/fuel ratio, such as a stoichiometric air/fuel ratio. A fuel injector may be provided for each cylinder.

The injected fuel mixes with air and creates an air/fuel mixture in the cylinder 114. Based upon a signal from the ECM 110, a spark actuator module 122 may energize a spark plug 124 in the cylinder 114. A spark plug may be provided for each cylinder. Spark generated by the spark plug 124 ignites the air/fuel mixture.

The engine 102 may operate using a four-stroke cycle or another suitable operating cycle. The four strokes, described below, may be referred to as the intake stroke, the compression stroke, the combustion stroke, and the exhaust stroke. During each revolution of a crankshaft (not shown), two of the four strokes occur within the cylinder 114. Therefore, two crankshaft revolutions are necessary for the cylinders to experience all four of the strokes.

During the intake stroke, air from the intake manifold 106 is drawn into the cylinder 114 through the intake valve 118. Fuel injected by the fuel injector 121 mixes with air and creates an air/fuel mixture in the cylinder 114. One or more fuel injections may be performed during a combustion cycle. During the compression stroke, a piston (not shown) within the cylinder 114 compresses the air/fuel mixture. During the combustion stroke, combustion of the air/fuel mixture drives the piston, thereby driving the crankshaft. During the exhaust stroke, the byproducts of combustion are expelled through an exhaust valve 126 to an exhaust system 127.

A low pressure fuel pump 142 draws fuel from a fuel tank 146 and provides fuel at low pressures to a high pressure fuel pump 150. While only the fuel tank 146 is shown, more than one fuel tank 146 may be implemented. The high pressure fuel pump 150 further pressurizes the fuel within a fuel rail 154. The fuel injectors of the engine 102, including the fuel injector 121, receive fuel via the fuel rail 154. Low pressures provided by the low pressure fuel pump 142 are described relative to high pressures provided by the high pressure fuel pump 150.

The low pressure fuel pump 142 may be an electrically driven pump. The high pressure fuel pump 150 may be a variable output pump that is mechanically driven by the engine 102. A pump actuator module 158 may control output of the high pressure fuel pump 150 based on signals from the ECM 110. The pump actuator module 158 may also control operation (e.g., ON/OFF state) of the low pressure fuel pump 142.

The engine system 100 includes a fuel pressure sensor 176. The fuel pressure sensor 176 measures a pressure of the fuel in the fuel rail 154. The engine system 100 may include one or more other sensors 180. For example, the other sensors 180 may include one or more other fuel pressure sensors, a mass air flowrate (MAF) sensor, a manifold absolute pressure (MAP) sensor, an intake air temperature (IAT) sensor, a coolant temperature sensor, an oil temperature sensor, a crankshaft position sensor, and/or one or more other suitable sensors.

Figure 2:
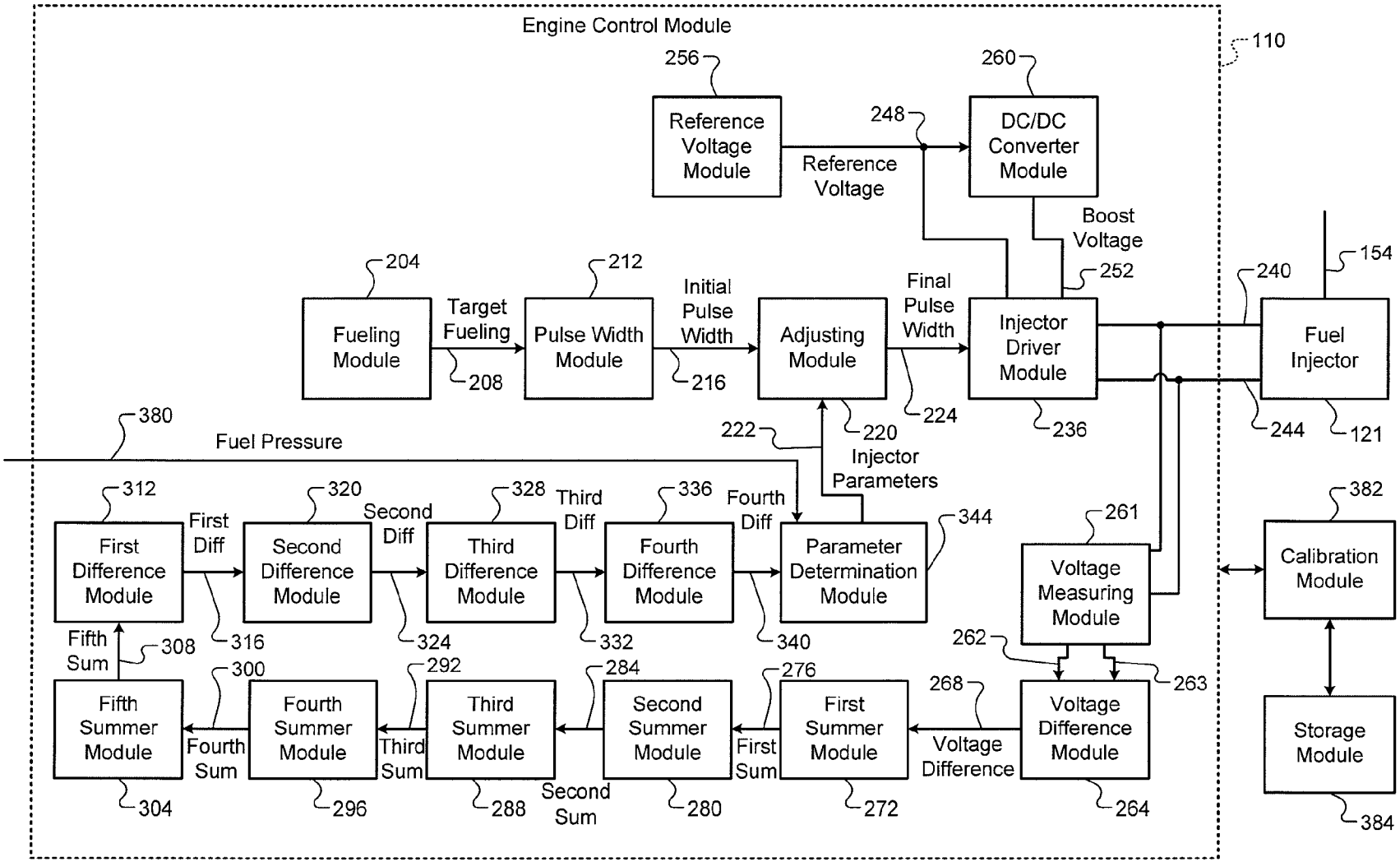
FIG. 2 is a functional block diagram of an example fuel control system including a portion of an engine control module.

Referring now to FIG. 2, a functional block diagram of an example fuel control system including an example portion of the ECM 110 is presented. A fueling module 204 determines target fuel injection parameters 208 for a fuel injection event of the fuel injector 121. For example, the fueling module 204 may determine a target mass of fuel for the fuel injection event and a target starting timing for the fuel injection event. The fueling module 204 may determine the target mass of fuel, for example, based on a target air/fuel ratio (e.g., stoichiometry) and an expected mass of air within the cylinder 114 for the fuel injection event. One or more fuel injection events may be performed during a combustion cycle of the cylinder 114.

A pulse width module 212 determines an initial (fuel injection) pulse width 216 for the fuel injection event based on the target mass of fuel. The pulse width module 212 may determine the initial pulse width 216 further based on pressure of the fuel within the fuel rail 154 and/or one or more other parameters. The initial pulse width 216 corresponds to a period to apply power to the fuel injector 121 during the fuel injection event to cause the fuel injector 121 to inject the target mass of fuel under the operating conditions.

Different fuel injectors, however, may have different closing periods, opening periods, opening magnitudes, and other characteristics. The closing period of a fuel injector may refer to the period between: a first time when power is removed from the fuel injector to close the fuel injector; and a second time when the fuel injector actually becomes closed and stops injecting fuel. Fuel injectors with longer closing periods will inject more fuel than fuel injectors with shorter closing periods despite all of the fuel injectors being controlled to inject the same amount of fuel.

The opening period of a fuel injector may refer to the period between: a first time when power is applied to the fuel injector to open the fuel injector; and a second time when the fuel injector actually becomes open and begins injecting fuel. Fuel injectors with longer opening periods will inject less fuel than fuel injectors with shorter opening periods despite all of the fuel injectors being controlled to inject the same amount of fuel. The opening magnitude of a fuel injector may correspond to how much the fuel injector opens for a fuel injection event.

An adjusting module 220 adjusts the initial pulse width 216 based on one or more injector parameters 222 determined for the fuel injector 121 to produce a final pulse width 224. The adjustment of the initial pulse width 216 may include lengthening or shortening the initial pulse width 216 to determine the final pulse width 224, such as by advancing or retarding a beginning of the pulse and/or advancing or retarding an ending of the pulse. Determination of the final pulse width 224 and the injector parameters 222 is described in detail below.

An injector driver module 236 determines a target current profile (not shown) based on the final pulse width 224. The injector driver module 236 applies high and low voltages to first and second electrical connectors of the fuel injector 121 via high and low side lines 240 and 244 to achieve the target current profile through the fuel injector 121 for the fuel injection event.

The injector driver module 236 may generate the high and low voltages using reference and boost voltages 248 and 252. The reference and boost voltages 248 and 252 may be direct current (DC) voltages. A reference voltage module 256 provides the reference voltage 248, for example, based on a voltage of a battery (not shown) of the vehicle. A DC/DC converter module 260 boosts (increases) the reference voltage 248 to generate the boost voltage 252.

A voltage measuring module 261 measures the high voltage at the first electrical connector of the fuel injector 121 and generates a high side voltage 262 based on the voltage at the first electrical conductor. The voltage measuring module 261 also measures the low voltage at the second electrical connector of the fuel injector 121 and generates a low side voltage 263 based on the voltage at the second electrical conductor. The voltage measuring module 261 measures the high and low voltages relative to a ground reference potential.

A voltage difference module 264 generates a voltage difference 268 based on a difference between the low side voltage 263 and the high side voltage 262. For example, the voltage difference module 264 may set the voltage difference 268 equal to the low side voltage 263 minus the high side voltage 262. For another example, the voltage difference module 264 may set the voltage difference 268 equal to the high side voltage 262 minus the low side voltage 263. The voltage difference module 264 samples the low side voltage 263 and the high side voltage 262 and generates values of the voltage difference 268 based on a predetermined sampling rate. A filter, such as a low pass filter (LPF) or another suitable type of filter, may be implemented to filter the voltage difference 268. An analog to digital converter (ADC) may also be implemented such that the voltage difference 268 includes corresponding digital values.

A first summer module 272 determines a first sum 276 by summing the last N values of the voltage difference 268. N is an integer greater than one. For example only, N may be 8 or another suitable value. The first summer module 272 updates the first sum 276 every N sampling periods such that the first sum 276 is updated each time that N new values of the voltage difference 268 have been received.

A second summer module 280 determines a second sum 284 by summing the last M values of the first sum 276. M is an integer greater than one. For example only, M may be 10 or another suitable value. The second summer module 280 updates the second sum 284 each time the first sum 276 is updated.

A third summer module 288 determines a third sum 292 by summing the last M values of the second sum 284. The third summer module 288 updates the third sum 292 each time the second sum 284 is updated. A fourth summer module 296 determines a fourth sum 300 by summing the last M values of the third sum 292. The fourth summer module 296 updates the fourth sum 300 each time the third sum 292 is updated. A fifth summer module 304 determines a fifth sum 308 by summing the last M values of the fourth sum 300. The fifth summer module 304 updates the fifth sum 308 each time the fourth sum 300 is updated. While the example of calculating the first-fifth sums 276, 284, 292, 300, and 308 is shown and discussed, two or more sums may be determined, and a greater or lesser number of summer modules may be implemented. The first summer module 272 reduces sampling errors and jitter and also reduces the number of later computations necessary. The other summer modules provide shape preserving filters. Also, while the second-fifth summer modules are each discussed as using M values, one or more of the second-fifth summer modules may use a different number of previous values.

A first difference module 312 determines a first difference 316 based on a difference between the fifth sum 308 and a previous (e.g., last) value of the fifth sum 308. A second difference module 320 determines a second difference 324 based on a difference between the first difference 316 and a previous (e.g., last) value of the first difference 316.

A third difference module 328 determines a third difference 332 based on a difference between the second difference 324 and a previous (e.g., last) value of the second difference 324. A fourth difference module 336 determines a fourth difference 340 based on a difference between the third difference 332 and a previous (e.g., last) value of the third difference 332.

The first difference 316 corresponds to and has the same shape as a first derivative (d/dt) of the voltage difference 268. The second difference 324 corresponds to and has the same shape as a second derivative ($d^2/dt^2$) of the voltage difference 268. The third difference 332 corresponds to and has the same shape as a third derivative ($d^3/dt^3$) of the voltage difference 268. The fourth difference 340 corresponds to and has the same shape as a fourth derivative ($d^4/dt^4$) of the voltage difference 268. In various implementations, the ECM 110 may include first, second, third, and fourth derivative modules (not shown) that determine the first, second, third, and fourth derivatives. The first, second, third, and fourth derivative modules may be included in place of or in addition to the first, second, third and fourth difference modules 312, 320, 328, and 336.

Additionally, minimum and maximum values of the first difference 316 occur at the same times as minimum and maximum values of the first derivative (d/dt) of the voltage difference 268. Minimum and maximum values of the second difference 324 also occur at the same times as minimum and maximum values of the second derivative ($d^2/dt^2$) of the voltage difference 268. Minimum and maximum values of the third difference 332 also occur at the same times as minimum and maximum values of the ($d^3/dt^3$) of the voltage difference 268. However, calculation of first-fourth derivatives is less computationally efficient than calculating the first-fourth differences 316, 324, 332, and 340, as discussed above. Since the first-fourth differences 316, 324, 332, and 340 are determined at a predetermined rate, the first-fourth differences 316, 324, 332, and 340 are an accurate representative of the first-fourth derivatives. Additionally, using sums instead of averages reduces computational complexity and maintains the shape of the input signal.

While the example of calculating the first-fourth differences 316, 324, 332, and 340 has been discussed, two or more differences may be determined, and a greater or lesser number of difference modules may be implemented. Also, while the example is discussed in terms of use of the voltage difference 268, the present application is applicable to identifying changes in other signals.

A parameter determination module 344 determines the injector parameters 222 for the fuel injector 121 based on the voltage difference 268 and the third and fourth differences 332 and 340. The parameter determination module 344 may determine the injector parameters 222 additionally or alternatively based on one or more other parameters. For example, the parameter determination module 344 may determine the injector parameters 222 based on the third and fourth derivatives of the voltage difference 268 in the same manner that the parameter determination module 344 determines the injector parameters 222 based on the third and fourth differences 332 and 340. In this case, the first, second, third and fourth difference modules 312, 320, 328, and 336 may determine the first, second, third, and fourth derivatives instead of or in addition to determining the first, second, third, and fourth differences.

Figure 3:
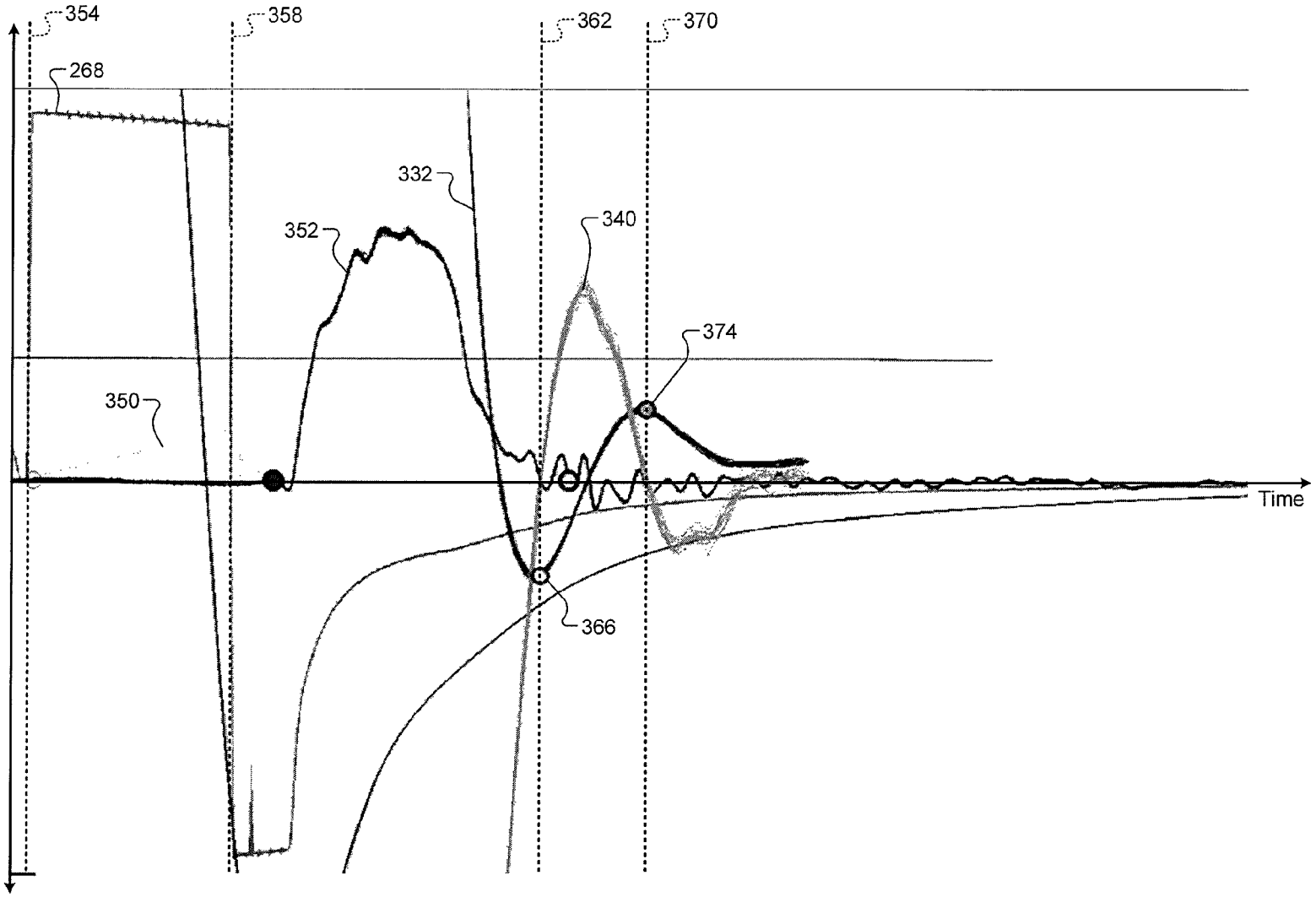
FIG. 3 is an example graph of voltage and current of a fuel injector, and various parameters determined based on the voltage for an injection event.

FIG. 3 includes a graph including example traces of the voltage difference 268, current 350 through the fuel injector 121, the third difference 332, the fourth difference 340 and fuel flow 352 versus time for a fuel injection event. Referring now to FIGS. 2 and 3, the injector driver module 236 applies a pulse to the fuel injector 121 from time 354 until time 358 for the fuel injection event. Current flows through the fuel injector 121 based on the application of the pulse to the fuel injector 121, as illustrated by 350.

The period between when the injector driver module 236 ends the pulse and when the fuel injector 121 reaches a fully closed state may be referred to as the closing period of the fuel injector 121. A first zero crossing of the fourth difference 340 that occurs after the injector driver module 236 ends the pulse may correspond to the time when the fuel injector 121 reaches the fully closed state. In FIG. 3, the fourth difference 340 first crosses zero at approximately time 362. The closing period of the fuel injector 121 therefore corresponds to the period between time 358 and time 362 in FIG. 3. The parameter determination module 344 determines the closing period of the fuel injector 121 based on the period between the time that the injector driver module 236 ends the pulse for a fuel injection event and the time that the fourth difference 340 first crosses zero after the end of the pulse.

The third difference 332 reaches a minimum value at the first zero crossing of the fourth difference 340. The minimum value of the third difference 332 is indicated by 366 in FIG. 3. The third difference 332 reaches a maximum value at a second zero crossing of the fourth difference 340 that occurs after the injector driver module 236 ends the pulse. In FIG. 3, the second zero crossing of the fourth difference 340 occurs at approximately time 370, and the maximum value of the third difference 332 is indicated by 374.

In various implementations, a first predetermined offset may be applied to the first zero crossing to identify the minimum value of the third difference 332 and/or a second predetermined offset may be applied to the second zero crossing to identify the maximum value of the third difference 332. For example, the minimum value of the third difference 332 may occur the first predetermined offset before or after the first zero crossing of the fourth difference 340 and/or the maximum value of the third difference 332 may occur the second predetermined offset before or after the second zero crossing of the fourth difference 340. The application of the first and/or second predetermined offsets may be performed to better correlate with the minimum and maximum values of the third difference 332.

The parameter determination module 344 determines an opening magnitude of the fuel injector 121 based on a difference between the minimum value 366 of the third difference 332 and the maximum value 374 of the third difference 332.

Based on the closing period of the fuel injector 121 and the opening magnitude of the fuel injector 121, the length of pulses applied to the fuel injector 121 can be adjusted such that the fuel injector 121 will as closely as possible inject the same amount of fuel as other fuel injectors, despite manufacturing differences between the fuel injectors. Adjustments are determined and applied for each fuel injector. Without the adjustments, the differences between the fuel injectors may cause the fuel injectors to inject different amounts of fuel.

The parameter determination module 344 may determine a closing period delta for the fuel injector 121 based on a difference between the closing period of the fuel injector 121 and a predetermined closing period. The predetermined closing period may be calibrated based on the closing periods of a plurality of fuel injectors. For example only, the parameter determination module 344 may set the closing period delta based on or equal to the predetermined closing period minus the closing period of the fuel injector 121.

The parameter determination module 344 may determine a closing period compensation value based on the closing period delta and a closing period adjustment value. For example only, the parameter determination module 344 may set the closing period compensation value based on or equal to a product of the closing period delta and the closing period adjustment value. The parameter determination module 344 may determine the closing period adjustment value based on the final pulse width 224 used for a fuel injection event and a fuel pressure 380 of the fuel injection event. The parameter determination module 344 may determine the closing period adjustment value, for example, using one of a function and a mapping that relates the final pulse width 224 and the fuel pressure 380 to the closing period adjustment value. The fuel pressure 380 corresponds to a pressure of the fuel provided to the fuel injector 121 for the fuel injection event and may be, for example, measured using the fuel pressure sensor 176.

The parameter determination module 344 may determine an opening period delta for the fuel injector 121 based on the final pulse width 224 used for a fuel injection event and a predetermined pulse width for the fuel injection event. For example only, the parameter determination module 344 may set the opening period delta based on a difference between the final pulse width 224 for the fuel injection event and the predetermined pulse width for the fuel injection event. The parameter determination module 344 may, for example, set the opening period delta based on or equal to the final pulse width 224 for the fuel injection event minus the predetermined pulse width for the fuel injection event.

The parameter determination module 344 may determine the predetermined pulse width for the fuel injection event based on the opening magnitude of the fuel injector 121 and the fuel pressure 380 for the fuel injection event. Determination of the opening magnitude of the fuel injector 121 is discussed above. The parameter determination module 344 may determine the predetermined pulse width, for example, using one of a function and a mapping that relates the opening magnitude and the fuel pressure 380 to the predetermined pulse width.

The parameter determination module 344 may determine an opening period compensation value based on the opening period delta and an opening period adjustment value. For example only, the parameter determination module 344 may set the opening period compensation value based on or equal to a product of the opening period delta and the opening period adjustment value. The parameter determination module 344 may determine the opening period adjustment value based on the final pulse width 224 used for a fuel injection event and a fuel pressure 380 of the fuel injection event. The parameter determination module 344 may determine the opening period adjustment value, for example, using one of a function and a mapping that relates the final pulse width 224 and the fuel pressure 380 to the opening period adjustment value. The fuel pressure 380 corresponds to a pressure of the fuel provided to the fuel injector 121 for the fuel injection event and may be, for example, measured using the fuel pressure sensor 176.

The parameter determination module 344 may determine the values in one or more lookup tables used to determine the opening and closing period adjustment values based on the final pulse width 224 the fuel pressure 380. Alternatively, the values in the lookup table may be determined in a laboratory setting using a calibration module 382 that communicates with the ECM 110. The parameter determination module 344 and/or a storage module 384 may store the values determined on, for example, non-transitory tangible computer readable medium.

As stated above, the adjusting module 220 adjusts the initial pulse width 216 for a fuel injection event based on one or more of the injector parameters 222 to determine the final pulse width 224 for the fuel injection event. For example only, the adjusting module 220 may set the final pulse width 224 based on the initial pulse width 216, the opening period compensation value, and the closing period compensation value. The adjusting module 220 may set the final pulse width 224, for example, using one of a function and a mapping that relates the initial pulse width 216, the opening period compensation value, and the closing period compensation value to the final pulse width 224. For example only, the adjusting module 220 may set the final pulse width 224 equal to or based on a sum of the initial pulse width 216, the opening period compensation value, and the closing period compensation value. While the above example is discussed in terms of the fuel injector 121, a respective opening period compensation value and a respective closing period compensation value may be determined and used for each fuel injector.

Figure 4:
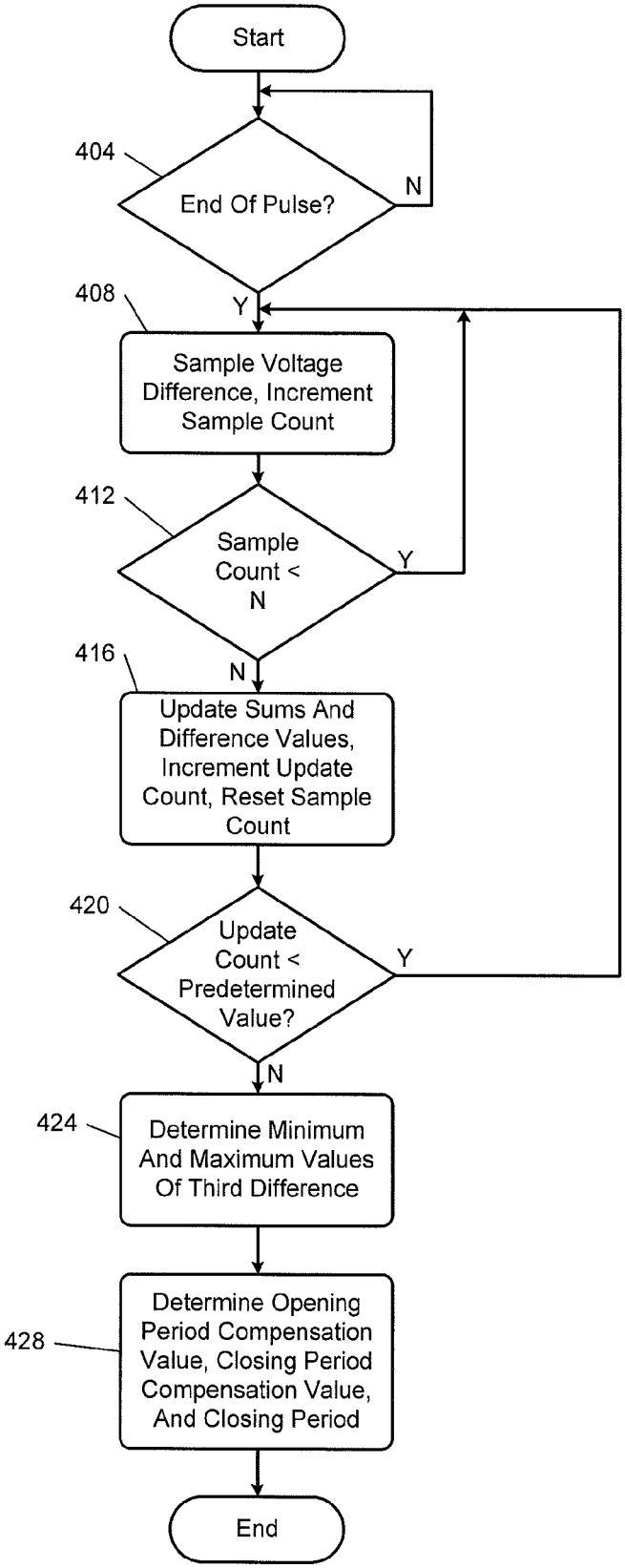
FIG. 4 is a flowchart depicting an example method of determining various parameters for a fuel injection event of a fuel injector.

FIG. 4 is a flowchart depicting an example method of determining the first-fifth sums 276, 284, 292, 300, and 308 and the first-fourth differences 316, 324, 332, and 340 for determining the closing period, the closing period compensation value, and the opening period compensation value for a fuel injection event of the fuel injector 121. Control may begin with 404 where the parameter determination module 344 determines whether the injector driver module 236 has stopped applying a pulse to the fuel injector 121 for the fuel injection event. If 404 is true, the parameter determination module 344 may start a timer, and control continues with 408. If 404 is false, control may remain at 404.

At 408, the voltage difference module 264 samples the high and low side voltages 262 and 263 and generates a value of the voltage difference 268 based on the samples. The parameter determination module 344 may also reset a sample counter value at 408. At 412, the parameter determination module 344 determines whether the sample counter value is less than N. As described above, N is the number of values used by the first summer module 272 to determine the first sum 276. If 412 is true, control may return to 408. If 412 is false, control continues with 416.

At 416, the first summer module 272 determines the first sum 276 based on the last N values of the voltage difference 268. The second summer module 280 determines the second sum 284 based on the last M values of the first sum 276. The third summer module 288 determines the third sum 292 based on the last M values of the second sum 284. The fourth summer module 296 determines the fourth sum 300 based on the last M values of the third sum 292. The fifth summer module 304 determines the fifth sum 308 based on the last M values of the fourth sum 300.

Also at 416, the first difference module 312 determines the first difference 316 between the fifth sum 308 and the last value of the fifth sum 308. The second difference module 320 determines the second difference 324 between the first difference 316 and the last value of the first difference 316. The third difference module 328 determines the third difference 332 between the second difference 324 and the last value of the second difference 324. The fourth difference module 336 determines the fourth difference 340 between the third difference 332 and the last value of the third difference 332. The parameter determination module 344 also increments an update counter value and resets the sample counter value at 416.

At 420, the parameter determination module 344 determines whether the update counter value is less than a predetermined value. If 420 is true, control returns to 408. If 420 is false, control continues with 424. The predetermined value is calibratable and is set based on the number of samples of the voltage difference 268 necessary to fill all of the following modules with new values: the first summer module 272, the second summer module 280, the third summer module 288, the fourth summer module 296, the fifth summer module 304, the first difference module 312, the second difference module 320, the third difference module 328, and the fourth difference module 336. For example only, based on the example of FIG. 2, the predetermined value may be set to greater than or equal to:

$$(N*M)+Q(N*(M-1))+N*R,$$

where N is the number of samples used by the first summer module 272, M is the number of samples used by the second, third, fourth, and fifth summer modules 280, 288, 296, and 304 (in the example where the same number of samples are used), Q is the number of summer modules implemented that update their outputs each time the first summer module 272 updates the first sum 276, and R is the number of difference modules implemented. In the example of FIG. 2, Q equals 4 (for the second, third, fourth, and fifth summer modules 280, 288, 296, and 304), and R equals 4 (for the first, second, third, and fourth difference modules 312, 320, 328, and 336).

At 424, the parameter determination module 344 may monitor the fourth difference 340 for the first zero crossing. The parameter determination module 344 may identify the minimum value of the third difference 332 as the value of the third difference 332 occurring at the first zero crossing of the fourth difference 340. The parameter determination module 344 may also monitor the fourth difference for the second zero crossing. The parameter determination module 344 may identify the maximum value of the third difference 332 as the value of the third difference 332 occurring at the second zero crossing of the fourth difference 340. While not explicitly shown, control continues to generate samples of the voltage difference 268 and to update the first, second, third, fourth, and fifth sums 276, 284, 292, 300, and 308 and the first, second, third, and fourth differences 316, 324, 332, and 340 at 424 to determine the minimum and maximum values of the third difference 332.

The parameter determination module 344 may determine closing period of the fuel injector 121 at 428. The parameter determination module 344 may determine the closing period of the fuel injector 121 based on the timer value at the first zero crossing of the fourth difference 340.

The parameter determination module 344 may also determine the opening period compensation value and the closing period compensation value for the fuel injector 121 at 428. The parameter determination module 344 determines the opening magnitude of the fuel injector 121 based on a difference between the minimum value of the third difference 332 and the maximum value of the third difference 332. The parameter determination module 344 may determine the closing period delta for the fuel injector 121 based on a difference between the closing period of the fuel injector 121 and the predetermined closing period. For example only, the parameter determination module 344 may set the closing period delta based on or equal to the predetermined closing period minus the closing period of the fuel injector 121.

The parameter determination module 344 may determine the closing period compensation value based on the closing period delta and the closing period adjustment value. For example only, the parameter determination module 344 may set the closing period compensation value based on or equal to a product of the closing period delta and the closing period adjustment value. The parameter determination module 344 may determine the closing period adjustment value for the fuel injection event based on the final pulse width 224 used for a fuel injection event and the fuel pressure 380 for the fuel injection event. The parameter determination module 344 may determine the closing period adjustment value, for example, using one of a function and a mapping that relates the final pulse width 224 and the fuel pressure 380 to the closing period adjustment value.

The parameter determination module 344 may determine the opening period delta for the fuel injector 121 based on the final pulse width 224 used for the fuel injection event and the predetermined pulse width for the fuel injection event. For example only, the parameter determination module 344 may set the opening period delta based on a difference between the final pulse width 224 for the fuel injection event and the predetermined pulse width for the fuel injection event. The parameter determination module 344 may, for example, set the opening period delta based on or equal to the final pulse width 224 for the fuel injection event minus the predetermined pulse width for the fuel injection event.

The parameter determination module 344 may determine the predetermined pulse width for the fuel injection event based on the opening magnitude of the fuel injector 121 and the fuel pressure 380 for the fuel injection event. The parameter determination module 344 may determine the predetermined pulse width, for example, using one of a function and a mapping that relates the opening magnitude and the fuel pressure 380 to the opening period adjustment value.

The parameter determination module 344 may determine the opening period compensation value based on the opening period delta and the opening period adjustment value. For example only, the parameter determination module 344 may set the opening period compensation value based on or equal to a product of the opening period delta and the opening period adjustment value. The parameter determination module 344 may determine the opening period adjustment value for the fuel injection event based on the final pulse width 224 used for a fuel injection event and the fuel pressure 380 for the fuel injection event. The parameter determination module 344 may determine the opening period adjustment value, for example, using one of a function and a mapping that relates the final pulse width 224 and the fuel pressure 380 to the opening period adjustment value.

As stated above, the closing period compensation value and the opening period compensation value can be used to adjust the initial pulse width 216 determined for future fuel injection events.

Figure 5:
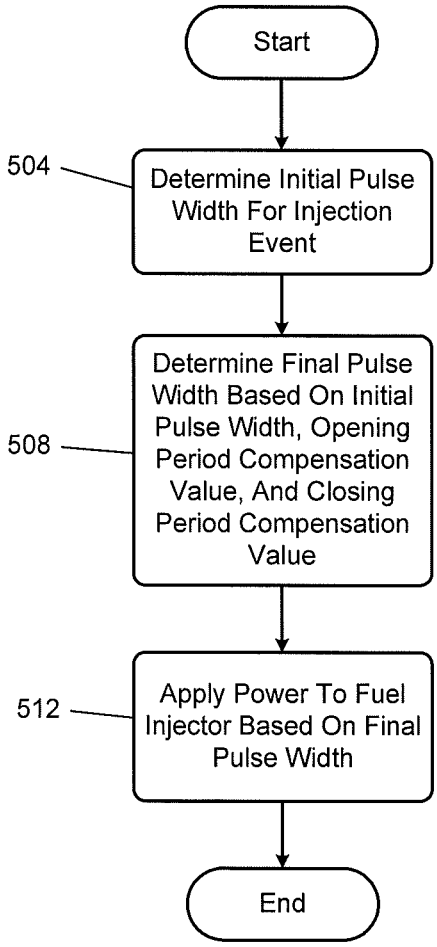
FIG. 5 is a flowchart depicting an example method of controlling fueling for a fuel injection event of the fuel injector.

FIG. 5 is a flowchart depicting an example method of controlling fueling for a fuel injection event of the fuel injector 121. Control may begin with 504 where the pulse width module 212 determines the initial pulse width 216 for a fuel injection event of the fuel injector 121. The pulse width module 212 may determine the initial pulse width 216 based on the target mass determined for the fuel injection event, which may be determined based on a target air/fuel mixture and a mass of air expected to be within the cylinder 114.

At 508, the adjusting module 220 adjusts the initial pulse width 216 based on the opening period compensation value and the closing period compensation value to produce the final pulse width 224. For example, the adjusting module 220 may set the final pulse width 224 equal to or based on a sum of the initial pulse width 216, the opening period compensation value, and the closing period compensation value. At 512, the injector driver module 236 applies power to the fuel injector 121 based on the final pulse width 224. The application of power to the fuel injector 121 should cause the fuel injector 121 to open and inject fuel for the fuel injection event.

Figure 6:
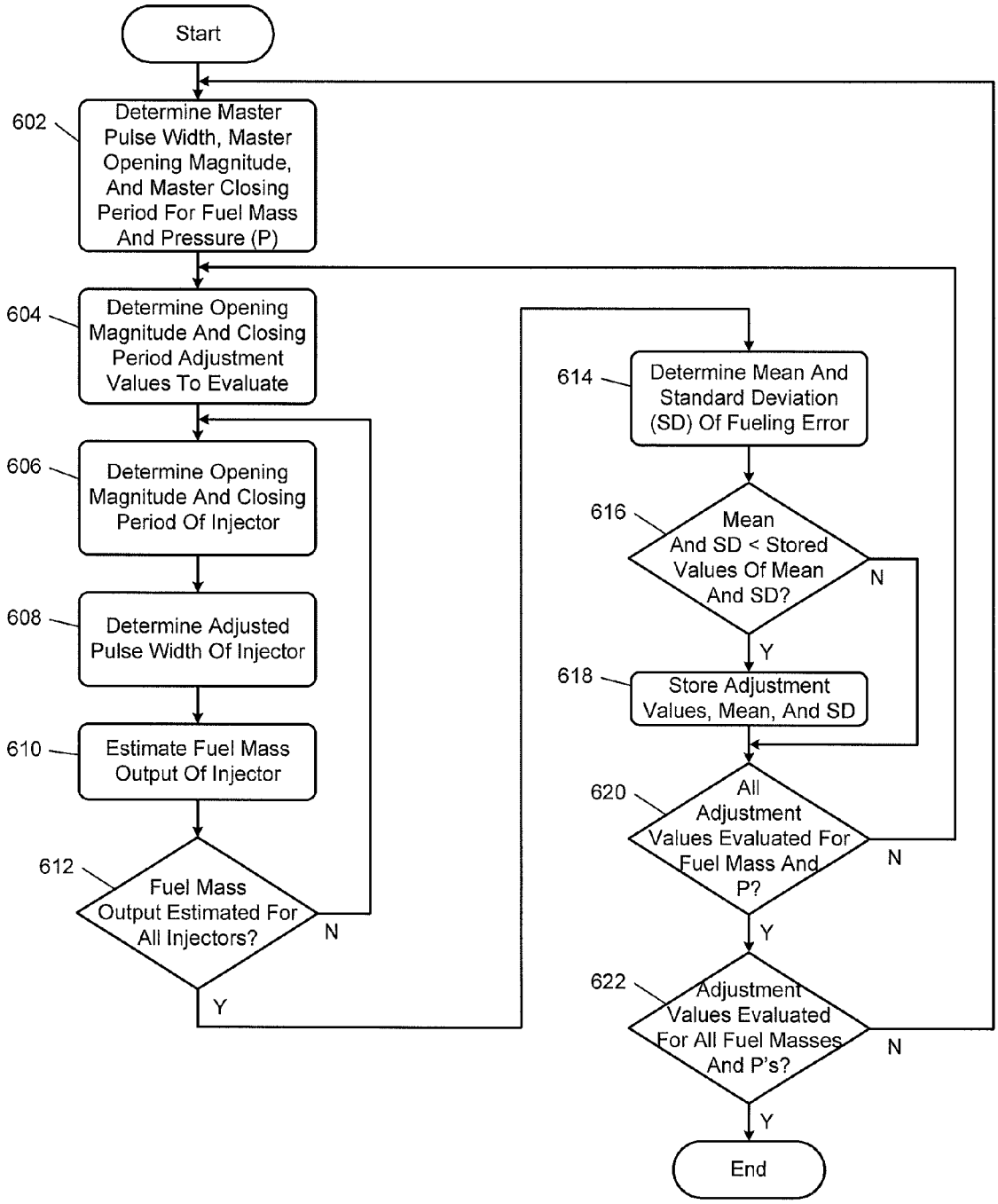
FIG. 6 is a flowchart depicting an example method of determining values in a lookup table for use in controlling fueling for a fuel injection event of the fuel injector.

FIG. 6 is a flowchart depicting an example method of determining values in a mapping or lookup table that may be used by the parameter determination module 344 to determine the opening and closing period adjustment values as described above. The lookup table relates a desired fuel mass and a desired fuel pressure to the opening and closing period adjustment values. The method shown in FIG. 6 may be executed by the parameter determination module 344 or by the calibration module 382 and the storage module 384.

At 602, the method determines a master pulse width, a master opening magnitude, and a master closing period for a desired fuel mass and a desired fuel pressure. For example, the method may select the master pulse width, the opening magnitude and the closing period from a plurality of master pulse widths, opening magnitudes, and closing periods, respectively, based on the desired fuel mass and fuel pressure. The master pulse widths, opening magnitudes, and closing periods may be predetermined by characterizing a certain number of injectors (e.g., 24 injectors).

At 604, the method determines an opening magnitude adjustment value and a closing period adjustment value to evaluate. For example, the method may initially set the adjustment values to zero, and then increase the adjustment values by a predetermined increment (e.g., 0.1) after each evaluation until the adjustment values are equal to one. At that point, the method may evaluate the same set of adjustment values at a different operating condition (e.g., a different fuel mass and fuel pressure).

At 606, the method determines an opening magnitude and a closing period for a specific injector of the engine 102. The method may determine the injector opening magnitude and the injector closing period based on the desired fuel mass and fuel pressure. For example, the method may determine the opening magnitude and closing period for the injector using a predetermined mapping of the desired fuel mass and fuel pressure to the opening magnitude and closing period.

At 608, the method determines an adjusted pulse width of the injector. For example, the method may determine the adjusted pulse width using a relationship such as $$PWadj=PWmstr+(OMmstr-OMinj)*Kom+(CPmstr-CPinj)*Kcp$$

where PWadj is the adjusted pulse width, PWmster is the master pulse width, OMmstr is the master opening magnitude, OMinj is the injector opening magnitude, Kom is the opening magnitude adjustment value, CPmster is the master closing period, CPinj is the injector closing period, and Kcp is the closing period adjustment value.

At 610, the method estimates a fuel mass output of the injector based on the adjusted pulse width, the desired fuel pressure, the injector opening magnitude, and the injector closing period. For example, the method may estimate the fuel mass output based on a predetermined relationship between the adjusted pulse width, the desired fuel pressure, the injector opening magnitude, the injector closing period, and the fuel mass output. The predetermined relationship may be embodied in a lookup table and/or an equation.

At 612, the method determines whether the fuel mass output has been estimated for all of the injectors in the engine 102. If the fuel mass output has been estimated for all of the injectors, the method continues at 614. Otherwise, the method returns to 606 and determines the opening magnitude and closing period for one of the injectors of the engine 102 for which the fuel mass output has not been estimated.

At 614, the method determines a mean and standard deviation of fueling errors associated with each of the injectors. The method may determine a fueling error of an injector by determining a difference between the fuel mass output of the injector and the desired fuel mass. At 616, the method determines whether the mean and the standard deviation of the fueling errors are less than stored values of the mean and the standard deviation. If the mean and the standard deviation of the fueling errors are less than the stored values, the method continues at 618. Otherwise, the method continues at 620. At 618, the method stores the opening magnitude and closing period adjustment values, as well as the corresponding mean and the standard deviation. The method may also store the adjusted pulse width of each injector as a desired pulse width of the injector at the desired fuel mass and fuel pressure.

At 620, the method determines whether all of opening magnitude and closing period adjustment values within a predetermined set of opening magnitude and closing period adjustment values have been evaluated for the desired fuel mass and fuel pressure. As indicated above, the predetermined set of opening magnitude and closing period adjustment values may vary from zero to one by a predetermined increment (e.g., 0.1). If all of the opening magnitude and closing period adjustment values have been evaluated for the desired fuel mass and the desired fuel pressure, the method continues at 622. Otherwise, the method continues at 604 and evaluates opening magnitude and closing period adjustment values that have not been evaluated.

At 622, the method determines whether the opening magnitude and closing period adjustment values have been evaluated for all desired fuel masses and desired fuel pressures within a predetermined set of desired fuel masses and desired fuel pressures. If the opening magnitude and closing period adjustment values have been evaluated for all of the desired fuel masses and fuel pressures within the predetermined set of desired fuel masses and desired fuel pressures, the method ends. Otherwise, the method continues at 602 and evaluates the opening magnitude and closing period adjustment values for a different desired fuel mass and pressure.

To determine the opening and closing period adjustment values using the lookup table, the parameter determination module 344 may set the desired pulse width and desired fuel pressure equal to the final pulse width 224 and the fuel pressure 380, respectively. The parameter determination module 344 may then set the adjustment values equal to the last values stored in the lookup table corresponding to the desired pulse width and the desired fuel pressure. The parameter determination module 344 may determine the opening period adjustment value based on the opening magnitude adjustment value by, for example, setting the opening period adjustment value equal to the opening magnitude adjustment value.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A fuel control system for a vehicle, comprising:

a voltage measuring module that measures first and second voltages at first and second electrical connectors of a fuel injector of an engine;

a first difference module that determines a first difference based on a difference between the first and second voltages;

a second difference module that determines a second difference between (i) the first difference and (ii) a previous value of the first difference;

a third difference module that determines a third difference between (i) the second difference and (ii) a previous value of the second difference; and an injector driver module that applies power to the fuel injector for a period and that adjusts a length of the period based on the third difference.

2. The fuel control system of claim 1 further comprising:

a parameter determination module that determines a minimum value of the third difference and a maximum value of the third difference, wherein the injector driver module adjusts the length of the period based on the minimum and maximum values of the third difference.

3. The fuel control system of claim 2 further comprising:

a pulse width module that determines an initial pulse width to apply to the fuel injector for a fuel injection event based on a target mass of fuel; and an adjustment module that adjusts the initial pulse width based on the minimum and maximum values of the third difference to produce a final pulse width, wherein the injector driver module adjusts the length of the period based on the final pulse width.

4. The fuel control system of claim 3 wherein:

the parameter determination module determines an opening period compensation value based on the minimum and maximum values of the third difference;

the parameter determination module determines a closing period compensation value based on the minimum value of the third difference; and the adjustment module adjusts the initial pulse width based on the closing period compensation value and the opening period compensation value to produce the final pulse width.

5. The fuel control system of claim 4 wherein:

the parameter determination module determines a closing period of the fuel injector based on a period between a first time when the injector driver module ends a pulse for a previous fuel injection event and a second time corresponding to the minimum value of the third difference;

the parameter determination module determines a closing period delta of the fuel injector based on a difference between the closing period of the fuel injector and a predetermined closing period; and the parameter determination module determines the closing period compensation value based on the closing period delta.

6. The fuel control system of claim 5 wherein:

the parameter determination module determines a closing period adjustment value based on the final pulse width of the previous fuel injection event and a pressure of fuel provided to the fuel injector for the previous fuel injection event; and the parameter determination module determines the closing period delta further based on the closing period adjustment value.

7. The fuel control system of claim 4 wherein:

the parameter determination module determines an opening magnitude of the fuel injector based on a difference between the minimum and maximum values of the third difference;

the parameter determination module determines a predetermined pulse width for a previous fuel injection event based on the opening magnitude;

the parameter determination module determines an opening period delta of the fuel injector based on a difference between the final pulse width for the previous fuel injection event and the predetermined pulse width for the previous fuel injection event; and the parameter determination module determines the opening period compensation value based on the opening period delta.

8. The fuel control system of claim 7 wherein:

the parameter determination module determines an opening period adjustment value based on the final pulse width of the previous fuel injection event and a pressure of fuel provided to the fuel injector for the previous fuel injection event; and the parameter determination module determines the opening period delta further based on the opening period adjustment value.

9. The fuel control system of claim 2 further comprising:

a fourth difference module that determines a fourth difference between (i) the third difference and (ii) a previous value of the third difference, wherein the injector driver module adjusts the length of the period for which power is applied to the fuel injector based on the third difference and the fourth difference.

10. The fuel control system of claim 9 wherein:

the parameter determination module determines the minimum value of the third difference based on a first zero-crossing of the fourth difference; and the parameter determination module determines the maximum value of the third difference based on a second zero-crossing of the fourth difference.

11. A fuel control method for a vehicle, comprising:

measuring first and second voltages at first and second electrical connectors of a fuel injector of an engine;

determining a first difference based on a difference between the first and second voltages;

determining a second difference between (i) the first difference and (ii) a previous value of the first difference;

determining a third difference between (i) the second difference and (ii) a previous value of the second difference;

applying power to the fuel injector for a period; and adjusting a length of the period based on the third difference.

12. The fuel control method of claim 11 further comprising:

determining a minimum value of the third difference and a maximum value of the third difference; and adjusting the length of the period based on the minimum and maximum values of the third difference.

13. The fuel control method of claim 12 further comprising:

determining an initial pulse width to apply to the fuel injector for a fuel injection event based on a target mass of fuel;

adjusting the initial pulse width based on the minimum and maximum values of the third difference to produce a final pulse width; and adjusting the length of the period based on the final pulse width.

14. The fuel control method of claim 13 further comprising:

determining an opening period compensation value based on the minimum and maximum values of the third difference;

determining a closing period compensation value based on the minimum value of the third difference; and adjusting the initial pulse width based on the closing period compensation value and the opening period compensation value to produce the final pulse width.

15. The fuel control method of claim 14 further comprising:

determining a closing period of the fuel injector based on a period between a first time when a pulse for a previous fuel injection event is ended and a second time corresponding to the minimum value of the third difference;

determining a closing period delta of the fuel injector based on a difference between the closing period of the fuel injector and a predetermined closing period; and determining the closing period compensation value based on the closing period delta.

16. The fuel control method of claim 15 further comprising:

determining a closing period adjustment value based on the final pulse width of the previous fuel injection event and a pressure of fuel provided to the fuel injector for the previous fuel injection event; and determining the closing period delta further based on the closing period adjustment value.

17. The fuel control method of claim 14 further comprising:

determining an opening magnitude of the fuel injector based on a difference between the minimum and maximum values of the third difference;

determining a predetermined pulse width for a previous fuel injection event based on the opening magnitude;

determining an opening period delta of the fuel injector based on a difference between the final pulse width for the previous fuel injection event and the predetermined pulse width for the previous fuel injection event; and determining the opening period compensation value based on the opening period delta.

18. The fuel control method of claim 17 further comprising:

determining an opening period adjustment value based on the final pulse width of the previous fuel injection event and a pressure of fuel provided to the fuel injector for the previous fuel injection event; and determining the opening period delta further based on the opening period adjustment value.

19. The fuel control method of claim 12 further comprising:

determining a fourth difference between (i) the third difference and (ii) a previous value of the third difference; and adjusting the length of the period for which power is applied to the fuel injector based on the third difference and the fourth difference.

20. The fuel control method of claim 19 further comprising:

determining the minimum value of the third difference based on a first zero-crossing of the fourth difference; and determining the maximum value of the third difference based on a second zero-crossing of the fourth difference.

21. A fuel control method for a vehicle, comprising:

measuring first and second voltages at first and second electrical connectors of a fuel injector of an engine;

determining a first derivative based on a difference between the first and second voltages;

determining a second derivative based on (i) the first derivative and (ii) a previous value of the first derivative;

determining a third derivative based on (i) the second derivative and (ii) a previous value of the second derivative;

applying power to the fuel injector for a period; and adjusting a length of the period based on the third derivative.

* * * * *